United States Patent [19]

Tokuno et al.

[11] Patent Number: 4,795,297

[45] Date of Patent: Jan. 3, 1989

[54] APPARATUS FOR FEEDING BOARDS

[75] Inventors: Masateru Tokuno, Hyogo; Tetsuya Sawada, Kyoto; Sadaaki Gotou, Osaka; Toshihiro Fukaya, Hyogo, all of Japan

[73] Assignees: Rengo Co., Ltd., Osaka; S.K. Engineering Co., Ltd., Shizuoka, both of Japan

[21] Appl. No.: 67,376

[22] Filed: Jun. 26, 1987

[30] Foreign Application Priority Data

Jul. 10, 1986 [JP] Japan ..... 61-163198

[51] Int. Cl.[4] ..... B65G 59/08

[52] U.S. Cl. ..... 414/795.4; 271/3.1; 271/151; 414/788.5; 414/798.9

[58] Field of Search ..... 414/33, 112; 271/3.1, 271/151

[56] References Cited

U.S. PATENT DOCUMENTS

| | | | |
|---|---|---|---|
| 2,707,568 | 5/1955 | Jackson | 414/112 X |
| 3,643,939 | 2/1972 | Nussbaum et al. | 271/3.1 X |
| 4,022,332 | 5/1977 | Freakes et al. | 414/112 X |
| 4,042,234 | 8/1977 | Tokuno | 271/151 |
| 4,049,260 | 9/1977 | Szymborski | 271/151 |
| 4,311,430 | 1/1982 | Frederick et al. | 271/3.1 X |
| 4,316,607 | 2/1982 | Hayashi et al. | 271/3.1 X |

*Primary Examiner*—Leslie J. Paperner

*Attorney, Agent, or Firm*—John F. A. Earley; John F. A. Earley, III

[57] ABSTRACT

An apparatus for feeding boards, said apparatus being provided with reversing arm means 23 which comprises a table 21 and a conveyance surface 22, said conveyance surface making an obtuse angle with said table, and fork means 33 capable of pivoting edge resting boards on the conveyance surface from a backwardly inclined posture to a forwardly inclined posture.

11 Claims, 4 Drawing Sheets

APPARATUS FOR FEEDING BOARDS

The present invention relates to an apparatus for feeding boards, which is capable of feeding boards such as cardboards, corrugated fiberboards etc. continuously to a following machine and, more particularly, relates to an apparatus for feeding boards, which is capable of turning a stack of horizontal boards to a posture in which the boards rest on their edges and have front faces facing in the direction of their movement, and which is capable of shoving edge resting boards onto a conveyor in a shingled fashion so that the boards may be fed continuously one by one to a hopper of a following machine.

Conventional apparatuses of this kind comprise reversing means which accept a stack of horizontal boards and turn them to a posture in which the boards rest on their edges and have front faces facing in the direction of their movement, delivery means which shove the edge resting boards onto a conveyor so that the boards are laid down in a shingled fashion, and which send the boards out of the reversing means, and conveyor means which transport the boards in the shingled fashion so that they may be fed one by one to a hopper of a following machine. The reversing means include reversing arm means which comprise a table for accepting a stack of horizontal boards and a conveyance surface for carrying the boards which rest on their edges and have front faces facing in the direction of their movement after they have been turned, said conveyance surface meeting at a right angle with the surface of said table. Besides, the delivery means are located at the conveyance surface of the reversing means.

Difficulty with the prior art apparatuses arises when the boards, which rest on their edges on the conveyance surface and have front faces facing in the direction of their movement, are brought down in turn from the leading one onto the conveyor means so that they may be laid down in a shingled fashion. A leading group of the boards are often brought down at the same time, and as a result, the boards are not brought down in the shingled fashion. For this sake, the operation of the apparatuses is unavoidably interrupted, and accordingly, automatic operation of the apparatuses is not at all possible. Furthermore, the deliverying speed of the apparatuses has to be slowed down so that the boards may be brought down in a shingled fashion.

An object of the invention is to provide an apparatus for feeding boards, which eliminates the before-mentioned difficulty, and which is able to deliver the boards in a perfectly shingled fashion at high speed.

In accordance with the object an apparatus for feeding boards according to the invention is provided with reversing means which include reversing arm means comprising a table for supporting a bottom surface of a stack of horizontal boards and a conveyance surface for supporting the edge resting boards after they have been turned, said table making an obtuse angle with said conveyance surface, and is provided with delivery means which include fork means for changing the posture of the boards from a backwardly inclined posture to a forwardly inclined posture in the direction of the movement.

In addition, the apparatus for feeding boards according to the invention is provided with bottom conveyor means which are arranged at the delivery end of the conveyance surface, and which are driven at a higher speed than that of the delivery means. Furthermore, the apparatus of the invention is provided with supports which are arranged at the delivery end of the bottom conveyor means, and which are capable of being pivoted between a position to be raised above the transportation surface of the bottom conveyor means and a position to be lowered below the transportation surface of conveyor means.

These and other objects, advantages, features and uses of the invention will be apparent during the courses of the following description when taken together with the accompanying drawings, wherein.

Figure 1:
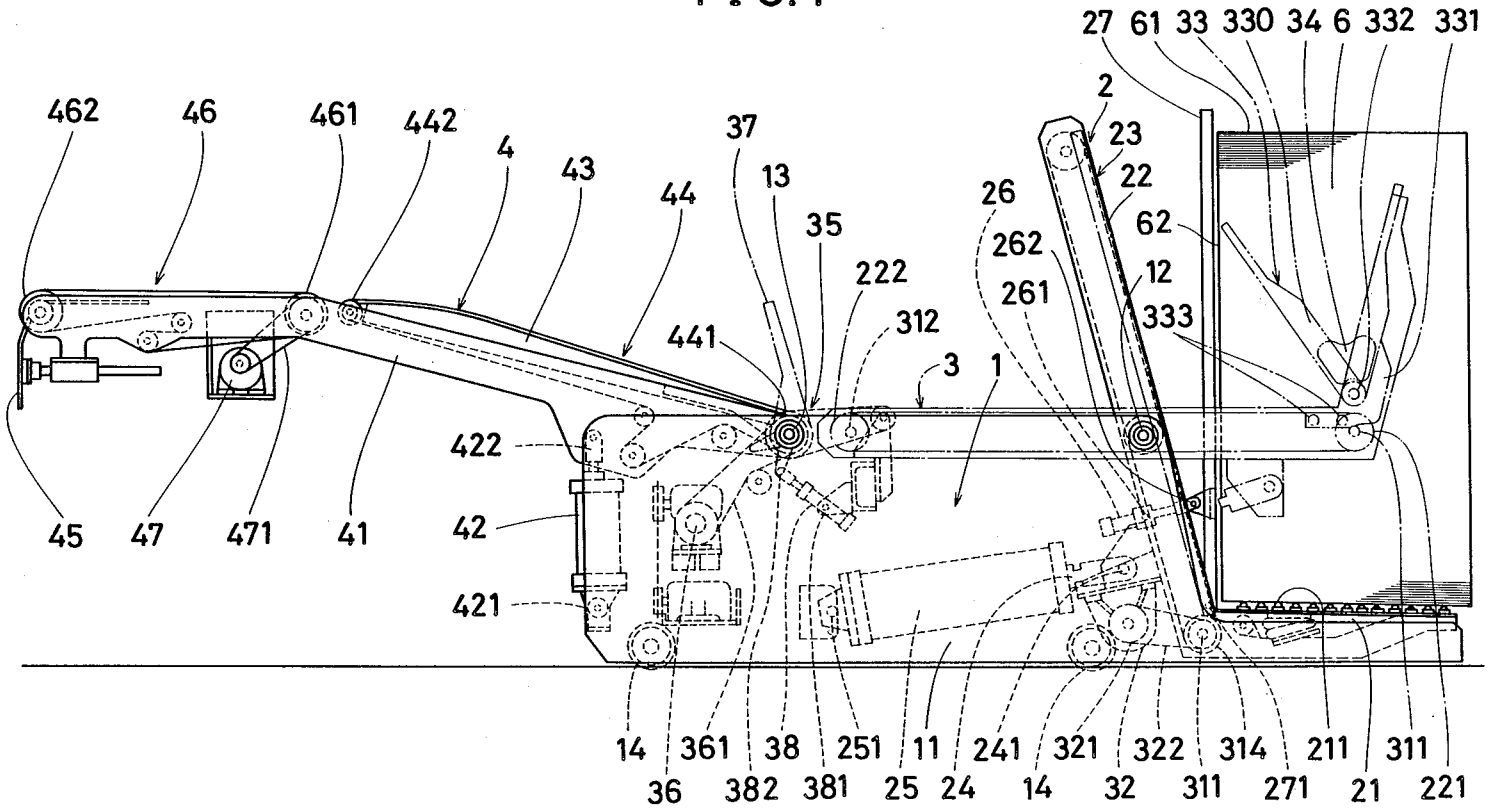
FIG. 1 is a side elevational view of an embodiment of an apparatus for feeding boards according to the invention.
Figure 2:
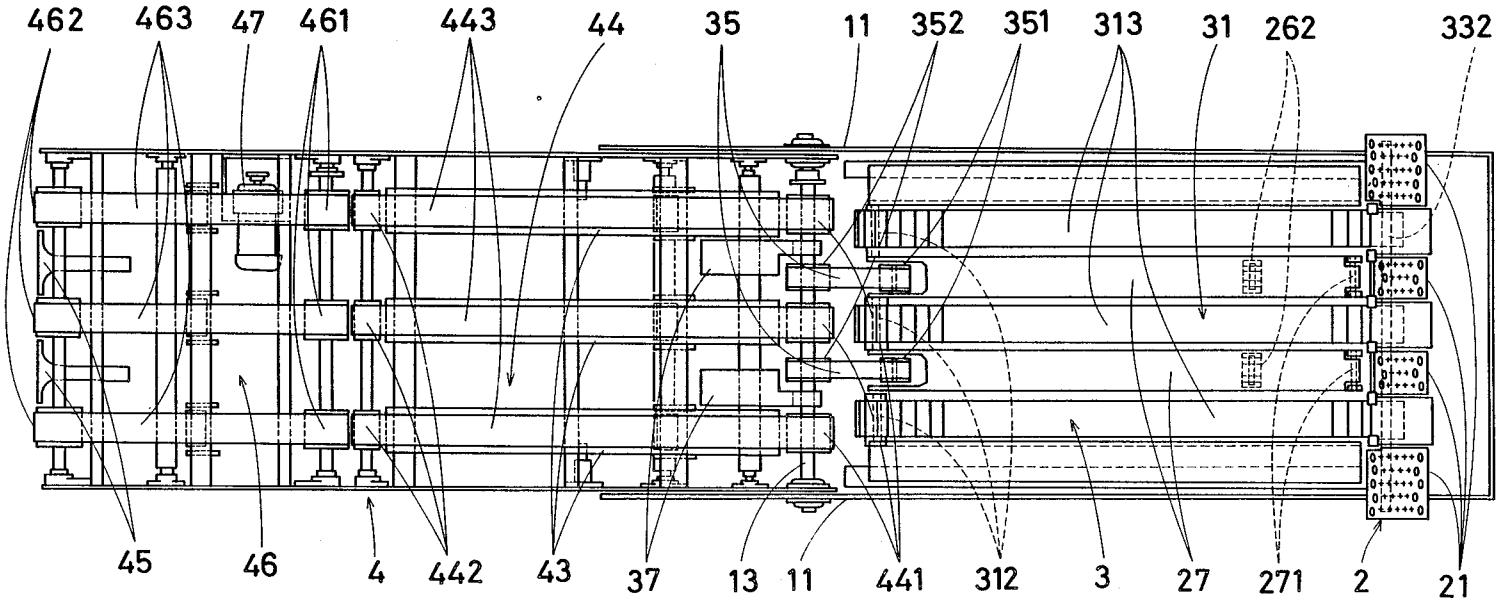
FIG. 2 is a horizontal plan view of the apparatus shown in FIG. 1, when reversing arm means are turned.

An apparatus for feeding boards as shown in FIGS. 1 and 2 comprises a frame 1, reversing means 2, delivery means 3 and conveyor means 4.

The reversing means 2 comprise reversing arm means 23 in which an obtuse angle is formed between a table 21 and a conveyance surface 22, a pressure cylinder device 25 having a rod 24 and supports 27 each having a pressure cylinder device 26. The reversing arm means 23 are pivotably mounted on the frame 1 by means of a supporting shaft 12, and the table 21 is provided with a large number of castors 211 at its surface. The conveyance surface 22 of the reversing arm means 23 has a feed end 221 and a delivery end 222, and the delivery means 3 are arranged at the conveyance surface 22. The pressure cylinder device 25 is pivotably connected with the frame 1 at its base portion 251, and a leading end 241 of the rod 24 is pivotably connected with the reversing arm means 23. The supports 27 are connected to each other by means of a connecting shaft 271, which is rotatably mounted near the feed end 221 of the conveyance surface 22. The supports 27 are capable of being stood perpendicularly with respect to the table 21 and capable of being lowered below the conveyance surface 22. The pressure cylinder devices 26 are pivotably connected with the reversing arm means 23 at respective fulcra 261, and leading ends 262 of rods of the pressure cylinder devices 26 are pivotably connected with the respective supports 27.

The delivery means 3 comprise delivery conveyor means 31, a driving device 32, fork means 33, air chambers 34, bottom conveyor means 35, a driving device 36, supports 37 and a pressure cylinder device 38. The delivery conveyor means 31, the driving device 32, the fork means 33 and the air chambers 34 are respectively mounted on the reversing arm means 23, while the bottom conveyor means 35, the driving device 36, the supports 37 and the pressure cylinder device 38 are mounted respectively on the frame 1. The delivery conveyor means 31 comprise three Caterpillar conveyors 313 which are driven around both a common driving shaft 311 located at the feed end 221 of the conveyance surface 22 and respective driven shaft 312 located at the delivery end 222 of the conveyance surface 22, and chains 322 are provided between a chainwheel 314 of the driving shaft 311 and a chainwheel 321 of the driving device 32. The fork means 33 comprise three forks 330 and three bases 331. The forks 330 are mounted on a connecting shaft 332 which is rotatably supported on the bases 331, which are connected with the Caterpillar conveyors 313 respectively. The bases 331 have rollers 333 for the purpose of being guided along the conveyance surface 22, and the air chambers 34 are provided between respective forks 330 and respective bases 331.

The bottom conveyor means 35 are provided with feed ends 351 which are located at positions between adjacent two driven shafts 312 of the delivery conveyor means 31 and delivery ends 352 located on the supporting shaft 13, and chains 361 are provided between a chainwheel (not shown) located at the delivery end 352 and the driving device 36. The supports 37 are pivotably supported on the supporting shaft 13. The pressure cylinder devices 38 are pivotably connected with the frame 1 at respective fulcra 381 and with the supports 37 at respective leading ends of their rods.

The conveyor means 4 comprise a pivotable frame 41, a pressure cylinder device 42, first conveyor means 44 which are provided with curved plates 43, second conveyor means 46 which are provided with guide plates 45 and a driving device 47. The pivotable frame 41 supports the first conveyor means 44 having a rising gradient and the second conveyor means 46 in a substantially horizontal level, and is pivotably mounted on the supporting shaft 13. The pressure cylinder device 42 is pivotably connected with the frame 1 at its base portion 421 and is pivotably connected with the pivotable frame 41 at a leading end 422 of its rod. The first conveyor means 44 are provided with conveyor belts 443 which pass around respective feed ends 441 located at the supporting shaft 13 and respective delivery ends 442, and chains 361 are provided between a chainwheel (not shown) of the feed end 441 and the driving device 36. The curved plates 43 are fixed respectively on the pivotable frame 41 and come in contact with respective undersurfaces of the conveyor belts 443 to guide them. The curved plates 43 are adapted to guide respective conveyor belts 443 so that the transportation surface of the first conveyor means 44 may have a rising gradient which is gradually decreased from the feed ends 441 to the delivery ends 442 at which the transportation surface is approximately levelled. The first conveyor means 44 are adapted to be driven simultaneously with the bottom conveyor means 35 at a higher speed than that of the bottom conveyor means 35. The second conveyor means 46 are provided with conveyor belts 463 which pass around respective feed ends 461 and respective delivery ends 462, and chains 471 are provided between a chainwheel (not shown) of respective feed ends and the driving device 47. The second conveyor means 46 are adapted to be driven at a higher speed than that of the first conveyor means 44.

The apparatus for feeding boards according to the embodiment is provided with a control device 5 for the purpose of being driven automatically, as shown in FIGS. 3 to 10. The control device 5 comprises limit switch means 51 arranged near the conveyance surface 22 on the table 21 to detect the loading of the boards on the table 21, photo-tube means 52 arranged near the feed end 221 of the conveyance surface 22 to change the speed of a return movement of the fork means 33 so that the speed is changed from a high speed to a low speed, photo-tube means 53 arranged near the delivery end 222 of the conveyance surface 22 to detect the arrival of the boards at the delivery end 222, photo-tube means 54 arranged at the delivery end 352 of the bottom conveyor 35 to detect the arrival of the boards at the delivery end 352, photo-tube means 55 arranged on the way of the first conveyor means 44 to detect completion of the passage of the boards over the supports 37 which have been pivoted, and photo-tube means 56 arranged near the delivery end 462 of the second conveyor means 46 to detect the arrival of the boards at the second conveyor means 46 and to change the speed of the apparatus so that the speed may be changed from a high speed at the beginning of the operation to a low speed in an ordinary operation.

In the foregoing embodiment, the reversing arm means 23 are of such a construction that a certain obtuse angle is formed between the table 21 and the conveyance surface 22. However, the reversing arm means 23 may be so modified that the table 21 and the conveyance surface 22 are pivotable with respect to each other, that is to say, the angle contained between the table 21 and the conveyance surface 22 is variable. In such an apparatus the supports 27 may be unnecessary.

Figure 3:
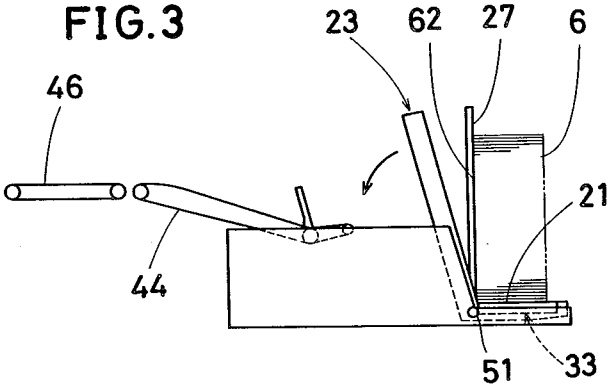

The operation of the apparatus according to the invention is as follows:

In the beginning, reversing arm means 23 are altered to a position as shown in solid lines in FIG. 1, wherein a table 21 is levelled and supports 27 are perpendicular, and forks 330 are lowered below the surface of the table 21. Subsequently, a stack of boards 6 are transported onto the table 21 by means of a feed conveyor (not shown). FIG. 3 shows this condition.

Figure 4:
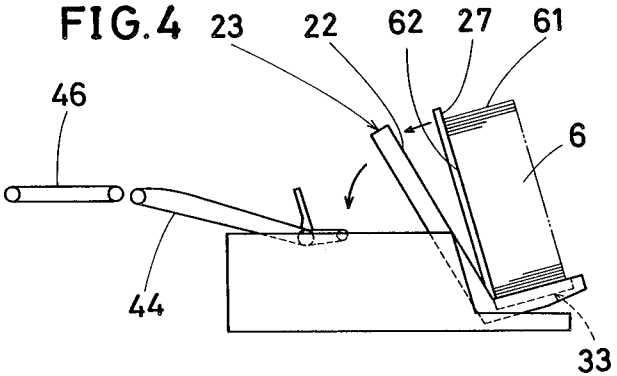

When front edges 62 of the boards 6 actuate limit switch means 51, a pressure cylinder device 25 is actuated to extend a rod 24 thereof and then the reversing arm means 23 begin to be pivoted. By the pivotal movement of the reversing arm means 23, the stack of the boards 6 is gradually altered to be in a backwardly inclined posture wherein the boards 6 come in contact with the pair of supports 27 at their front edges 62 and their upper faces 61 facing in the direction of their movement. FIG. 4 shows this condition.

Figure 5:
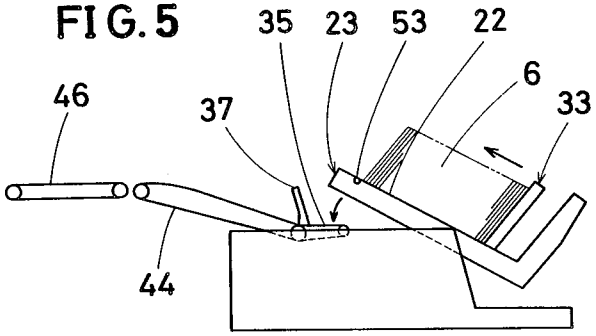
FIGS. 3–10 are diagrammatic side elevational views of various steps of the operation of the embodiment.

During the pivotal movement of the reversing arm means 23, a pair of pressure cylinder devices 26 are actuated to retract respective leading ends 262 of their rods. Accordingly, the supports 27 which are mounted on a connecting shaft 271 are lowered below a conveyance surface 22. Thus, the boards 6 are altered to be in a backwardly inclined posture wherein they stand on their front edges 62 on the reversing arm means 23. After the supports 27 have been lowered below the conveyance surface 22, a driving device 32 is operated at high speed as used at the beginning of the operation and the running of a delivery conveyor 31 is commenced. Owing to the running of the delivery conveyor 31, fork means 33 are moved forwardly or upwardly. When a leading board of the boards 6 actuates photo-tube means 53, the driving device 32 is stopped, and accordingly the movement of the delivery conveyor 31 and the fork means 33 is stopped. FIG. 5 shows this condition.

After the pivotal movement is completed, the reversing arm means 23 are in a position as shown in chain-dotted lines in FIG. 1 and the conveyance surface 22 is levelled. Then the driving device 32 and a driving device 36 are operated at high speed. Thus, the running of the delivery conveyor means 31, the fork means 33 and bottom conveyor means 35 is commenced. Since the running speed of the bottom conveyor means 35 is faster than the speed of the delivery conveyor means 31 and the fork means 33, the distance between respective front edges 62 of the boards 6 is enlarged when the boards 6 are on the bottom conveyor means 35 as compared with the distance which the boards 6 have when they are on the delivery conveyor means 31.

Figure 6:
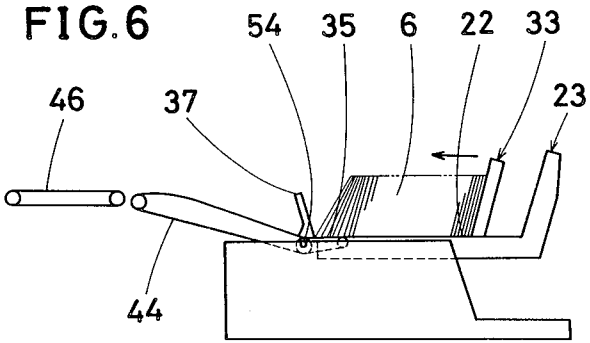

When a leading board of the boards 6 reaches a delivery end 352 of the bottom conveyor means 35, photo-tube means 54 is actuated. Thus, the operation of the driving device 32 and the operation of the driving device 36 are stopped, and accordingly the running of each of the delivery conveyor means 31, the fork means 33, the bottom conveyor means 35 and the first conveyor means 44 is stopped. FIG. 6 shows this condition.

Figure 7:
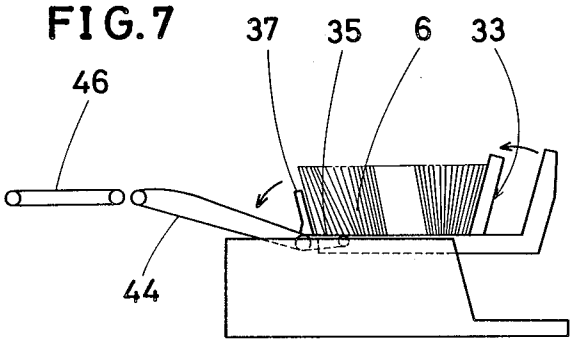

After each running of the delivery conveyor means 31, the fork means 33, the bottom conveyor means 35 and the first conveyor means 44 has been stopped, air is injected into air chambers 34. Thus, forks 330 are pivoted around the connecting shaft 332 and altered from a backwardly inclined posture to a forwardly inclined posture. Accordingly, the contiguous boards 6 which rest on their edges in the backwardly inclined posture in the direction of their movement are altered to a forwardly inclined posture wherein the boards 6 are leaning against supports 37. FIG. 7 shows this condition.

Subsequently, a pressure cylinder device 38 is actuated, and thus the supports 37 are pivoted so that the supports 37 are lowered below the transportation surface of the first conveyor means 44, as supporting the boards 6 in the forwardly inclined posture. At last, the boards 6 are laid down in a shingled fashion on the first conveyor means 44.

After the completion of the pivotal movement of the supports, 37 the driving device 32, the driving device 36 and a driving device 47 are actuated. Accordingly, the delivery conveyor means 31, the fork means 33, the bottom conveyor means 35, the first conveyor means 44 and second conveyor means 46 are operated respectively at their respective high speeds. Thus, the boards 6 in the shingled fashion are gradually transferred from the first conveyor means 44 to the second conveyor means 46.

At this time, the conveyor belts 443 of the first conveyor means 44 are moved along respective curved surfaces of the curved plates 43, and accordingly, the transportation surface of the first conveyor means 44 has a rising gradient which is gradually decreased from the feed end 441 to the delivery end 442 at which the transportation surface is approximately levelled. Accordingly, the boards 6 which are being conveyed in the forwardly inclined posture on the first conveyor means 44 are gradually turned in a shingled fashion and reach the delivery end 442, and then the boards 6 are transferred to the second conveyor means 46. It never happens that the tailing edge of the preceding board is raised upon the leading edge of the following board. Besides, since the running speed of the first conveyor means 44 is faster than that of the bottom conveyor means 35, and since the running speed of the second conveyor means 46 is faster than that of the first conveyor means 44, the distance between the adjacent boards in the direction of the transportation is gradually enlarged as they are transferred from the bottom conveyor means 35 to the first conveyor means 44 and from the first conveyor means 44 to the second conveyor means 46.

Figure 8:
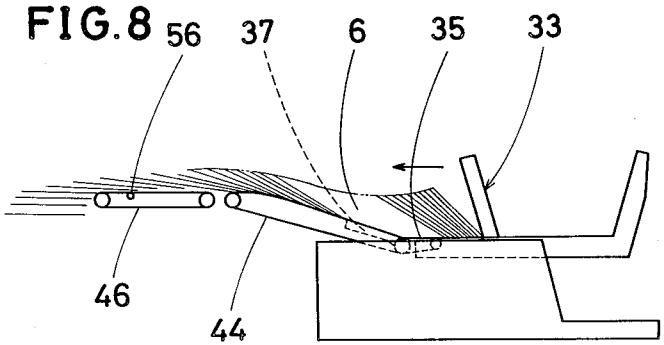

When the leading one of the boards 6 passes photo-tube means 56, the photo-tube means 56 are actuated, and thus the operation of each of the driving device 32, the driving device 36 and a driving device 47 is changed from a high speed as in the beginning of the operation, at which they are being operated up to that time, to a low speed as in the ordinary operation. Accordingly, the delivery conveyor means 31, the fork means 33, the bottom conveyor means 35, the first conveyor means 44 and the second conveyor means 46 are subsequently operated at the low speed as in the ordinary operation. Thus, the boards 6 are fed one by one into a hopper of a following machine. FIG. 8 shows this condition.

Figure 9:
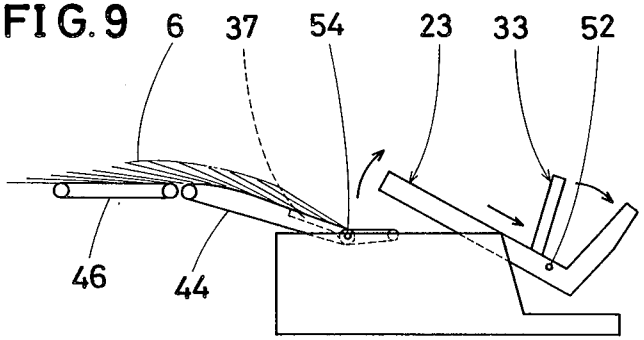

When the tailing one of the boards 6 passes the photo-tube means 54, by way of the actuation of the photo-tube means 54 the driving device 32 is stopped, and thus the running of each of the delivery conveyor means 31 and the fork means 33 is stopped. Immediately after the stoppage, the driving device 32 is driven to rotate reversely at the high speed as in the beginning of the operation, and thus the delivery conveyor means 31 and the fork means 33 begin to be returned toward the feed end 221 of the conveyance surface 22 at high speed. Furthermore, by way of the actuation of the photo-tube means 54 the pressure cylinder device 25 is actuated to retract the rod 24, and thus the reversing arm means 23 commence the pivotal movement for returning to the original position. FIG. 9 shows this condition.

While the delivery conveyor means 31 and the fork means 33 go back toward the feed end 221, at the time when the fork means 33 pass the photo-tube means 52, by way of the actuation of the photo-tube means 52, the operation of the driving device 32 is changed to the low speed. Subsequently, when the fork means 33 reach the feed end 221 of the delivery conveyor means 31, the driving device 32 is stopped, and thus the delivery conveyor means 31 and the fork means 33 are stopped. Furthermore, when the fork means 33 reach the feed end 221, compressed air which has been injected into the air chambers 34 is released, and thus the forks 330 are returned to the original position below the surface of the table 21.

When the pivotal movement of the reversing arm means 23 is completed, the table 21 is levelled. Then, the pressure cylinder device 26 is actuated to extend the leading end 262 of its rod, and accordingly the supports 27 are returned to the upright position.

Figure 10:
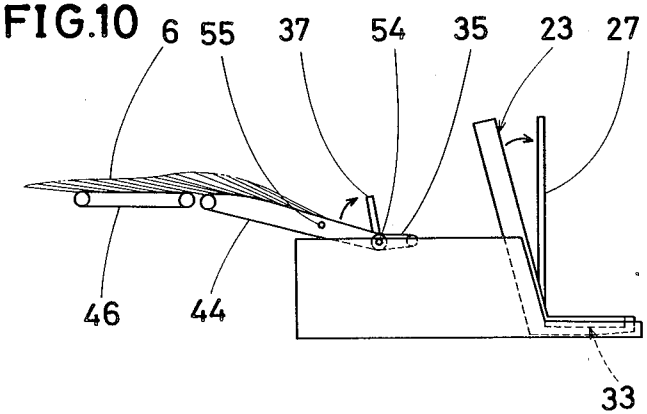

When the tailing one of the boards 6 passes the photo-tube means 55, by way of the actuation of the photo-tube means 55 the pressure cylinder device 38 is actuated to extend the leading end 382 of its rod, and thus the supports 37 are returned to the raised position. FIG. 10 shows this condition. In this way all of the preparation for a subsequent operation is completed.

The apparatus for feeding boards according to the invention is provided with reversing arm means 23 which comprise a table 21 and a conveyance surface 22, said conveyance surface making an obtuse angle with said table, and with fork means 33 capable of changing the posture of the boards which rest on their edges on the conveyance surface 22 from a backwardly inclined posture to a forwardly inclined posture. Thus, when the reversing arm means 23 is pivoted after a stack of horizontal boards 6 have been put on the table 21, the boards 6 slip with respect to each other in the direction of the pivotal movement of the reversing arm means 23 so that respective front edges 62 may come in contact with the conveyance surface 22, and thus the configuration of the boards 6 may be changed into a backwardly inclined one. In this configuration the distance between respective positions at which the respective boards come in contact with the conveyance surface 22 is enlarged. The fork means 33 is capable of changing the posture of the boards from the backwardly inclined one to a forwardly inclined one. Besides, in the apparatus according to the invention the running speed of the bottom conveyor means 35 is faster than that of the delivery conveyor means 31, whereby the distance between the respective boards in the direction of the transportation is enlarged. Furthermore, the apparatus according to the invention is provided with supports 37 with which the boards 6 is gradually pivoted from a forwardly inclined posture to a perfectly shingled posture. Accordingly, it never happens that following boards come under preceding boards. Owing to the boards 6 being laid down in a perfectly shingled fashion, the apparatus according to the invention is capable of being operated automatically at high speed. The apparatus according to the invention is also provided with the conveyor means 4 which are adapted to have a curved transportation surface having a rising gradient which is gradually decreased from the feed end of the surface to the delivery end at which the transportation surface is approximately levelled, whereby the apparatus can convey the boards at high speed, as keeping the boards in the perfectly shingled fashion on the conveyor means without deformation of the posture of the boards. This enables the conveyor means that is to say the apparatus according to the invention to be shortened.

We claim:

1. An apparatus for feeding boards such as cardboards, corrugated fiberboards, and the like in a shingled fashion to a following machine, comprising a table for receiving a stack of horizontal boards, the table having a front end portion and a rear end portion, a conveyance surface mounted on and extending upwardly from the rear end portion of the table forming an obtuse angle between the conveyance surface and the table, means for rotating the table and conveyance surface to orient the boards so that the boards rest on their edges on the conveyance surface and are backwardly inclined against the table, first conveyor means located at the conveyance surface for conveying the boards forwardly, fork means pivotally connected to the first conveyor means for orienting the boards on the first conveyor means from a backwardly inclined posture to a forwardly inclined posture, and second conveyor means for conveying the boards to the following machine in a shingled fashion.

2. The apparatus of claim 1, further including supports pivotally mounted on the conveyance surface adjacent to and extending upwardly from and perpendicular to the table, said supports being pivotally mounted to permit pivotal movement from a position perpendicular to the table to a position below the conveyance surface.

3. The apparatus of claim 1, the conveyance surface having a feed end and a delivery end, and the first conveyor means including a delivery conveyor means located along the conveyance surface for conveying the boards forwardly on the conveyance surface and a bottom conveyor means located at the delivery end of the conveyance surface for conveying the boards to the second conveyor means, the bottom conveyor means conveying the boards at a faster rate than the delivery conveyor means.

4. The apparatus of claim 3, the delivery conveyor means having a feed end, a delivery end, and a transportation surface, the second conveyor means having a transportation surface, and further including supports pivotally mounted at the delivery end of the delivery conveyor means, said supports being pivotally mounted to permit pivotal movement in a forward direction from a position above the transportation surface of the delivery conveyor means to a position below the transportation surface of the second conveyor means.

5. The apparatus of claim 1, the second conveyor means having a feed end, a delivery end, and a transportation surface, the transportation surface being curved such that it has a rising gradient which gradually decreases from the feed end of the second conveyor means to the delivery end of the second conveyor means.

6. An apparatus for feeding boards such as cardboards, corrugated fiberboards, and the like in a shingled fashion to a following machine, comprising a table for receiving a stack of horizontal boards, the table having a front end portion and a rear end portion, a conveyance surface mounted on and extending upwardly from the rear end portion of the table forming an obtuse angle between the conveyance surface and the table, means for rotating the table and conveyance surface to orient the boards so that the boards rest on their edges on the conveyance surface and are backwardly inclined against the table, first conveyor means located at the conveyance surface for conveying the boards forwardly, fork means pivotally connected to the first conveyor means for orienting the boards on the first conveyor means from a backwardly inclined posture to a forwardly inclined posture, second conveyor means for conveying the boards to the following machine in a shingled fashion, further including supports pivotally mounted on the conveyance surface adjacent to and extending upwardly from and perpendicular to the table, said supports being pivotally mounted to permit pivotal movement from a position perpendicular to the table to a position below the conveyance surface, the conveyance surface having a feed end and a delivery end, and the first conveyor means including a delivery conveyor means located along the conveyance surface for conveying the boards forwardly on the conveyance surface and a bottom conveyor means located at the delivery end of the conveyance surface for conveying the boards to the second conveyor means, the bottom conveyor means conveying the boards at a faster rate than the delivery conveyor means, the delivery conveyor means having a feed end, a delivery end, and a transportation surface, the second conveyor means having a transportation surface, and further including supports pivotally mounted at the delivery end of the delivery conveyor means, said supports being pivotally mounted to permit pivotal movement in a forward direction from a position above the transportation surface of the delivery conveyor means to a position below the transportation surface of the second conveyor means, and the second conveyor means having a feed end, a delivery end, and a transportation surface, the transportation surface being curved such that it has a rising gradient which gradually decreases from the feed end of the second conveyor means to the delivery end of the second conveyor means.

7. An apparatus for feeding boards, said apparatus comprising reversing means provided with reversing arm means which comprise a table and a conveyance surface, and which receive a stack of horizontal boards on the table and turn the stack so that the boards rest on their edges on the conveyance surface and have front faces facing in the direction of their movement, delivery means provided with delivery conveyor means which are located at the conveyance surface, and which forwardly pivot the boards resting on the conveyance surface and send the boards out as a continuous flow of forwardly shingled boards, and conveyor means provided with conveyors for transporting the shingled boards to a following machine, characterized in that the reversing arm means are provided with reversing arm means which comprise a table and a conveyance surface making an obtuse angle with the table, and which are adapted to turn the stack of horizontal boards on the table so that the boards are backwardly inclined on the conveyance surface as they lean against the table, and that the delivery means are provided with fork means which are pivotally connected to the delivery conveyor means, and which are capable of changing the posture of the boards from the backwardly inclined posture to a forwardly inclined posture on the delivery conveyor means.

8. An apparatus for feeding boards as claimed in claim 7, wherein the reversing means are further provided with supports which are mounted on the conveyance surface at the feed end thereof pivotally in the direction of the pivotal movement of the reversing arm means, and which is pivoted from a position perpendicular to the table to a position below the conveyance surface during the pivotal movement of the reversing arm means.

9. An apparatus for feeding boards as claimed in claim 7, wherein the delivery means are further provided with bottom conveyor means which are located at the delivery end of the delivery conveyor means, and which is driven faster than the delivery conveyor means.

10. An apparatus for feeding boards as claimed in claim 9, wherein the delivery conveyor means are further provided with supports which are located at the delivery end of the bottom conveyor means, and which are pivoted forwardly in the direction of the movement of the boards from a position above the transportation surface of the bottom conveyor means to a position below the transportation surface of the conveyors of the conveyor means.

11. An apparatus for feeding boards as claimed in claim 7, wherein the conveyors of the conveyor means have a transportation surface which is so curved that the transportation surface has a rising gradient which is gradually decreased from the feed end thereof to the delivery end thereof.

* * * * *